US007749032B1

(12) United States Patent
Yin et al.

(10) Patent No.: US 7,749,032 B1
(45) Date of Patent: Jul. 6, 2010

(54) PROBE CONNECTOR

(75) Inventors: Te-Hung Yin, Taipei (TW); Yung-Yi Chen, Taipei (TW); Shu-Fang Li, Taipei (TW); Jui-Pin Lin, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/491,244

(22) Filed: Jun. 25, 2009

(51) Int. Cl.
*H01R 13/24* (2006.01)

(52) U.S. Cl. ..... 439/824; 439/482

(58) Field of Classification Search ..... 439/824, 439/482, 700

See application file for complete search history.

(56) References Cited

U.S. PATENT DOCUMENTS 3,753,103 A * 8/1973 Tetreault et al. ..... 324/72.5

* cited by examiner

*Primary Examiner*—Javaid Nasri

(57) ABSTRACT

A probe connector has an insulating housing having at least one inserting hole and an installing groove adjacent to the inserting hole for communicating with thereof. At least one probe pin assembly mounted to the inserting hole comprises a cylindraceous barrel, an elastic element received in the barrel, and a plunger mounted to the barrel and exposing from an end of the barrel. The barrel has a main body, with an opening formed thereon and facing the installing groove. A fixing element fixed in the installing groove has an elastic arm which is formed with a resting portion projecting into a chamber surrounded by the main body through the opening. The resting portion resiliently rests against a side of the plunger when the plunger is pressed downwards to deflect to contact an inner surface of the main body by an opposite side thereof.

6 Claims, 3 Drawing Sheets

PROBE CONNECTOR

BACKGROUND OF THE INVENTION

1. Field of the Invention

The present invention relates to a probe connector, and particularly to a probe connector having a structure capable of assisting a plunger to contact a barrel securely.

2. The Related Art

Probe connectors are mainly used in mobile phones for electrically connecting with the contacts of electronic cards or batteries mounted to the mobile phones. The conventional probe connector generally includes an insulating housing and a plurality of probe pin assemblies mounted in the insulating housing. The insulating housing has a plurality of through holes for receiving the probe pin assemblies. The probe pin assembly includes a barrel, an elastic element received in the barrel, and a plunger mounted to the barrel. The plunger is formed with a ramped bottom surface against an end of the elastic element. The probe pin assemblies are mounted into the through holes, with the plungers projecting outside the insulating housing. In use, the ramped bottom surface of the plunger will compress and distort the elastic element when the plunger is pressed downwards. In turn, an elastic force stored in the elastic element will make the plunger deflect to contact an inner surface of the barrel, achieving electrical connection between the plunger and the barrel. However, such electrical connection between the barrel and the plunger is unstable and apt to break off each other instantly and discontinuously when the probe connector suffers from an unexpected force, thereby affecting the normal use of the mobile phone.

SUMMARY OF THE INVENTION

Accordingly, an object of the present invention is to provide a probe connector having a structure capable of assisting a plunger to contact a barrel reliably. The probe connector has an insulating housing having at least one inserting hole and an installing groove adjacent to the inserting hole for communicating with thereof. At least one probe pin assembly mounted to the inserting hole comprises the cylindraceous barrel, an elastic element received in the barrel, and the plunger mounted to the barrel and exposing from an end of the barrel. The barrel has a main body, with an opening formed thereon and facing the installing groove. A fixing element fixed in the installing groove has an elastic arm which is formed with a resting portion projecting into a chamber surrounded by the main body through the opening. The resting portion resiliently rests against a side of the plunger when the plunger is pressed downwards to deflect to contact an inner surface of the main body by an opposite side thereof.

As described above, the fixing element, which is located in the installing groove, has the resting portion projecting into the barrel through the opening. When the plunger is pressed downwards to extrude the resting portion outwards, in turn, the resting portion provides a force slanting the plunger to contact the inner surface of the main body steadily, preventing the plunger from breaking off the main body instantly and discontinuously when the probe connector suffers from an unexpected force.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENTS

Figure 1:
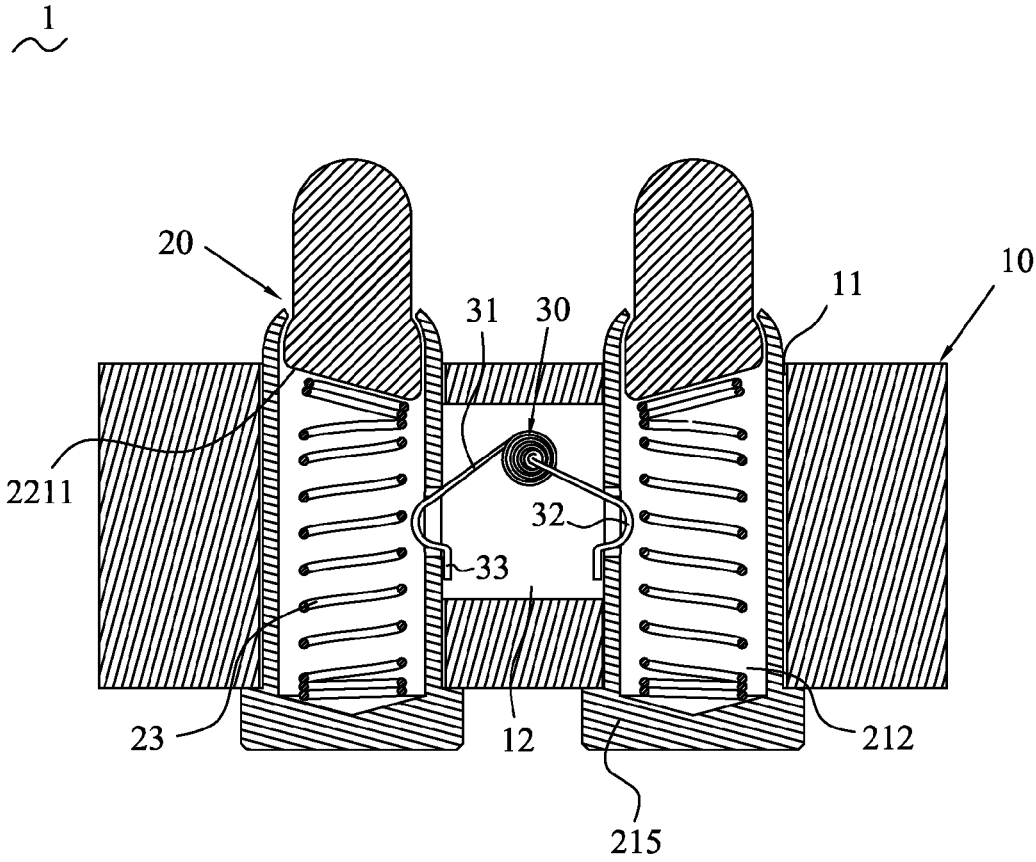
FIG. 1 is a cross-sectional view of a probe connector of a first embodiment in accordance with the present invention.

Referring to the drawings in greater detail, and first to FIG. 1, the first embodiment of the invention is embodied in a probe connector 1. The probe connector 1 includes an insulating housing 10 and a plurality of probe pin assemblies 20 mounted to the insulating housing 10. The insulating housing 10 is substantially rectangular and has a plurality of columned inserting holes 11, for receiving the probe pin assemblies 20. The inserting holes 11 are spaced away from one another. An installing groove 12 is formed between the two contiguous inserting holes 11 and communicates with the corresponding inserting holes 11.

Figure 2:
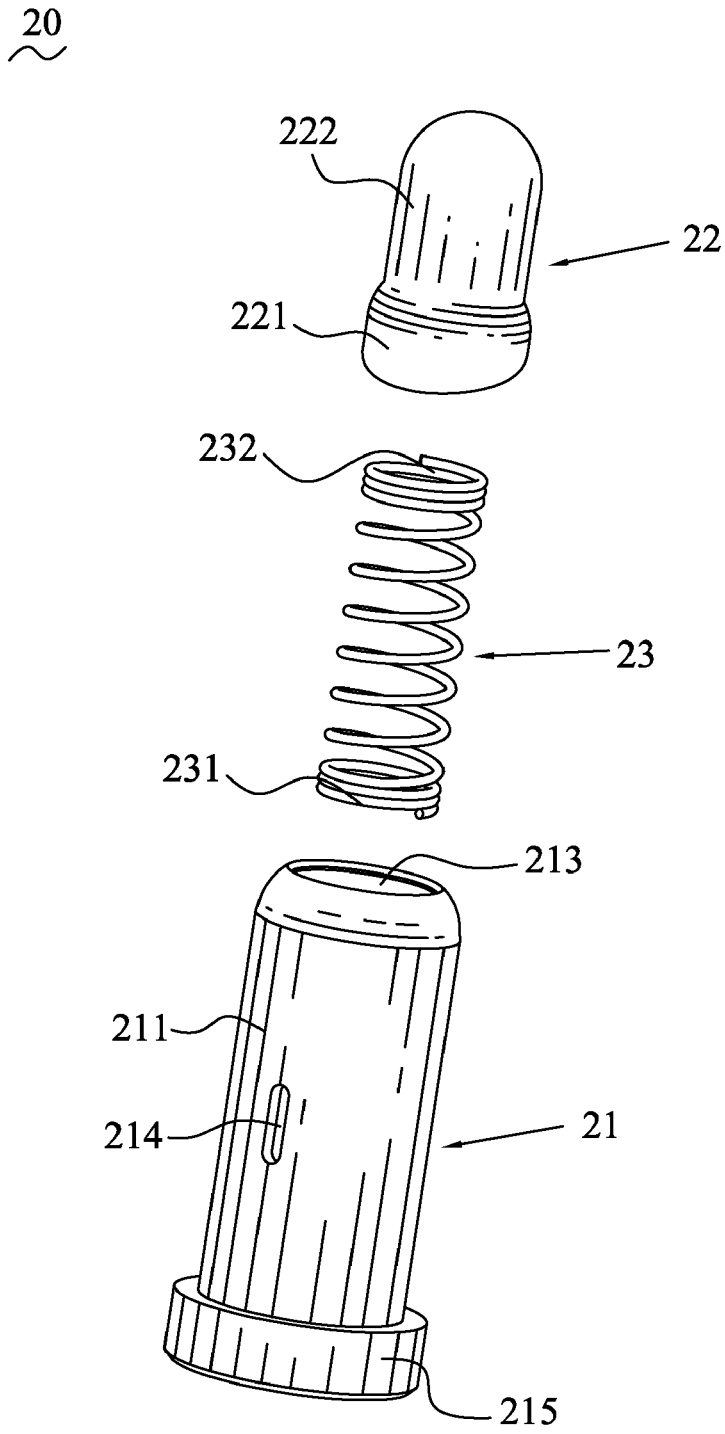
FIG. 2 is an exploded perspective view of a probe pin assembly of the probe connector shown in FIG. 1.

Please refer to FIGS. 1-2, the probe pin assembly 20 includes a hollow barrel 21, a plunger 22 and an elastic element 23 received in the barrel 21. The barrel 21 and the plunger 22 are made of metallic material. The barrel 21 has a cylindraceous main body 211, surrounding a chamber 212, and defines a base 215 integrally sealed one end of the main body 211 for being against the elastic element 23. The main body 211 has an opening or slot 214 at a substantial middle portion thereof and communicating with the chamber 212. In this embodiment, the slot 214 extends along a longitudinal direction of the main body 211. The other end of the main body 211 is bent inwards to form an opening 213 when the plunger 22 is mounted to the barrel 21, for fixing the plunger 22 and the barrel 21 together. The base 215 is a short-pillar shape and has an outer diameter larger than that of the main body 211.

The plunger 20 of cylindrical shape includes a basic portion 221 with a ramped bottom surface 2211, and a contact portion 222 extending upwards from a top end of the basic portion 221. The diameter of the contact portion 222 is less than that of the basic portion 221, with a free end shaped as a dome. The basic portion 221 is received in the chamber 212 of the barrel 21 and the contact portion 222 extends out of the barrel 21 through the opening 213. The outer dimension of the basic portion 221 is less than the inner dimension of the main body 211 for allowing the basic portion 221 to be inclinably received in the chamber 212. The dimension of the opening 213 is less than the outer dimension of the basic portion 221 for preventing the basic portion 221 from removing out of the chamber 212. The elastic element 23 is arranged inside the main body 211, and defines a first end 231 abutting against the base 215 and a second end 232 abutting against the ramped bottom surface 2211 of the basic portion 221.

The probe connector 1 further has a fixing element. In this embodiment, the fixing element is a torsion spring 30. The torsion spring 30 defines two elastic arms 31. Free ends of the elastic arms 31 are bent towards each other to form resting portions 32 of arc shape. Each of the resting portions 32 has a distal end bent opposite to the corresponding elastic arm 31 to form a stopping portion 33. In assembly, the probe pin assemblies 20 are mounted into the inserting holes 11, with the slots 214 adjusted to face the installing groove 12. The bases 215 are disposed to button a bottom surface of the insulating housing 10. The contact portions 222 of the plunger 22 project outside a top surface of the insulating housing 10 for electrically connecting with an outer electronic device (not shown). The torsion spring 30 is placed in the installing groove 12. The resting portions 32 respectively project into the chambers 212 through the slots 214. The stopping portions 33 are disposed to lean against outer surfaces of the main bodies 211 for restraining the resting portions 32.

Figure 3:
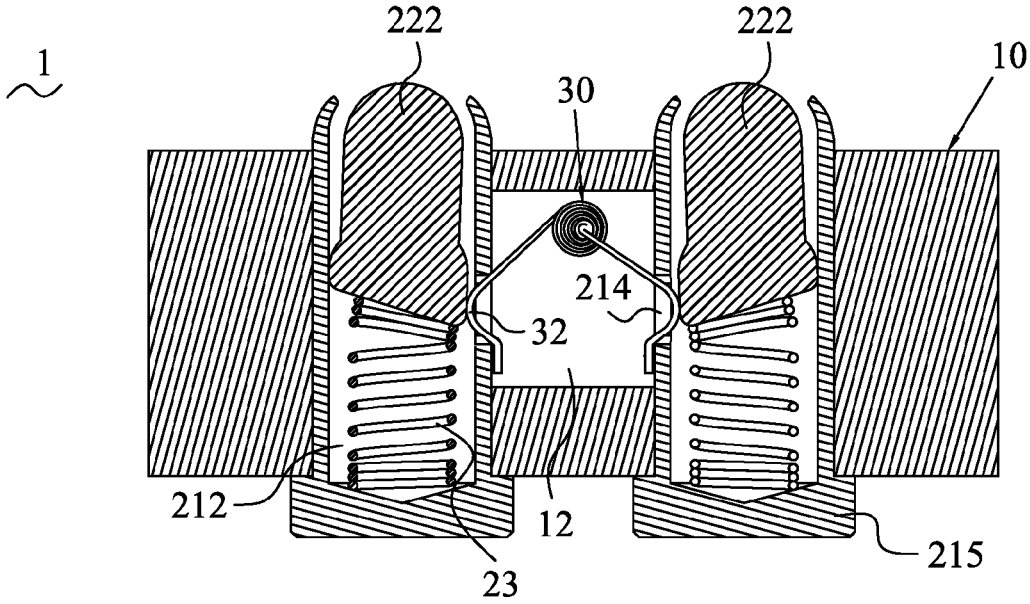
FIG. 3 is a cross-sectional view of the probe connector shown in FIG. 1, wherein plungers are pressed inside respective barrels.

Referring to FIGS. 2-3, when the contact portion 222 of the plunger 22 is pressed downwards, the elastic element 23 is compressed downwards and generates an opposite force which acts on the ramped bottom surface 2211 of the basic portion 221 so that the basic portion 221 is deflected to contact an inner surface of the main body 211. The resting portion 32 is resiliently pushed outwards by a side of the basic portion 221 and generates an opposite force which acts on the side of the basic portion 211 opposite to a contact side of the basic portion 221 which contacts with the main body 211 by means of deflection of the basic portion 221, guaranteeing the basic portion 221 to contact the main body 211 steadily, without affecting by an unexpected shock or the like.

Figure 4:
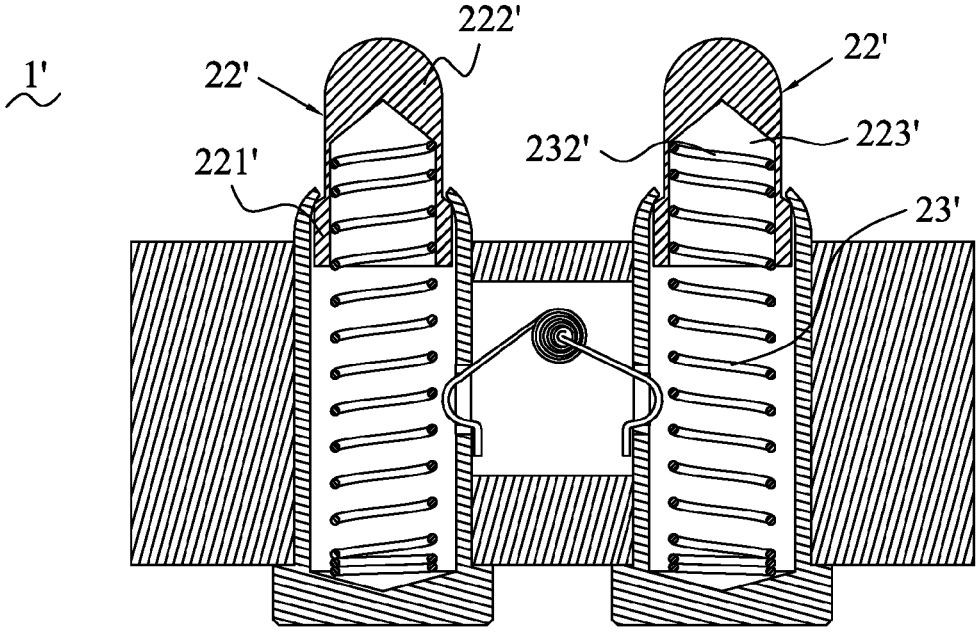
FIG. 4 is a cross-sectional view of a probe connector of a second embodiment in accordance with the present invention.

It should be noted that the construction of the probe pin assembly can be changed for meeting the different demands and should not be limited. For instance, shown in FIG. 4, the probe connector 1' in the second embodiment is analogue to the probe connector 1 in the first embodiment except for the plunger 22'. The plunger 22' has a receiving hole 223', with an opening at a bottom of the basic portion 221'. The receiving hole 223' extends in the contact portion 222' a distance, adapted for receiving the second end 232' of the elastic element 23'. The fixing element may be formed by bending a metal wire or a metal strip, with one elastic arm, which is fixed in the installing groove and has a free end of the elastic arm projecting into the chamber of the barrel through the slot for deflecting the basic portion of the plunger, or molded with insulative material to form at least one elastic arm of which a free end projects into the chamber of the barrel through the slot for deflecting the basic portion of the plunger.

As described above, the torsion spring, which is located between the probe pin assemblies, has the resting portions respectively projecting into the chambers of the probe pin assemblies through the slots. When the plungers are pressed downwards to make the basic portion extrude the resting portion outwards, in turn, the resting portions provide the opposite forces pushing the basic portions to contact the inner surfaces of the main bodies steadily, preventing the basic portions from breaking off the main bodies instantly and discontinuously when the probe connector suffers from the unexpected force.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A probe connector, comprising:

an insulating housing having at least one inserting hole, and an installing groove adjacent to the inserting hole for communicating with thereof;

at least one probe pin assembly mounted to the inserting hole, the at least one probe pin assembly comprising a cylindraceous barrel, an elastic element received in the barrel, and a plunger mounted to the barrel and exposing from an end of the barrel, the barrel having a main body, with an opening formed thereon and facing the installing groove; and a fixing element fixed in the installing groove having an elastic arm, the elastic arm being formed with a resting portion projecting into a chamber surrounded by the main body through the opening, wherein the resting portion resiliently rests against a side of the plunger when the plunger is pressed downwards to deflect to contact an inner surface of the main body by an opposite side thereof.

2. The probe connector as claimed in claim 1, wherein the insulating housing has two inserting holes spaced away from each other, the installing groove is formed between the inserting holes and communicating with the inserting holes.

3. The probe connector as claimed in claim 2, wherein the fixing element is a torsion spring, the torsion spring having two elastic arms, free ends of the elastic arms are bent towards each other to form the resting portions of arc shape.

4. The probe connector as claimed in claim 3, wherein the opening is a slot for allowing the resting portion to pass therethrough.

5. The probe connector as claimed in claim 3, wherein each of the resting portions has a distal end bent opposite to the corresponding elastic arm to form a stopping portion, the stopping portion is disposed to lean against an outer surface of the main body.

6. The probe connector as claimed in claim 1, wherein the plunger has a basic portion, the basic portion is shaped with a ramped bottom surface against an end of the elastic element for making the basic portion deflect to touch the main body when the plunger is pressed downwards.

* * * * *